United States Patent [19]

Kirchoff

[11] Patent Number: 4,480,159

[45] Date of Patent: Oct. 30, 1984

[54] SUB-MINIATURE THREE POSITION SWITCH WITH BUILT-IN LEVER LOCK

[75] Inventor: Francis D. Kirchoff, Newton, Mass.

[73] Assignee: Alco Electronic Products, Inc., Andover, Mass.

[21] Appl. No.: 525,717

[22] Filed: Aug. 23, 1983

Related U.S. Application Data

[63] Continuation-in-part of Ser. No. 337,594, Jan. 7, 1982, abandoned.

[51] Int. Cl.[3] ..... H01H 9/20

[52] U.S. Cl. ..... 200/42 T; 200/339; 200/291; 200/321; 74/536

[58] Field of Search ..... 200/42 T, 676, 291, 200/318, 320–325, 327, 329, 339, 42 A, 42 R; 74/519, 520, 527, 528, 532, 534, 536, 566

[56] References Cited

U.S. PATENT DOCUMENTS

| | | | |
|---|---|---|---|
| 2,723,571 | 11/1955 | Koenig | 200/318 X |
| 2,885,905 | 5/1959 | Larkin | 200/322 X |
| 3,001,417 | 9/1961 | Becker et al. | 200/318 |
| 3,604,868 | 9/1971 | Batchellen et al. | 200/42 T |
| 4,117,284 | 9/1978 | Kirchoff et al. | 200/67 G |
| 4,121,065 | 10/1978 | Woodard | 200/42 T |
| 4,215,257 | 7/1980 | Repplinger | 200/67 G |

FOREIGN PATENT DOCUMENTS

| | | | |
|---|---|---|---|
| 0685563 | 4/1964 | Canada | 200/322 |
| 0964888 | 7/1964 | United Kingdom | 200/291 |

*Primary Examiner*—Stephen Marcus
*Assistant Examiner*—Ernest G. Cusick
*Attorney, Agent, or Firm*—Pearson & Pearson

[57] ABSTRACT

A toggle switch of sub-miniature dimensions eliminates the need for machining flat parts on the toggle lever or drilling a pin on the toggle lever by mounting a one piece lever lock insert within the upper portion of the cylindrical housing of the toggle lever, above the spherical portion of the lever, the insert having three aligned, generally truncated conical recesses in the top surface thereof, the larger openings being each adapted to selectively receive the generally circular, spring pressed detent on the end of the toggle handle and the smaller openings merging with the straight parallel side walls of a guide slot, equal in width to the diameter of the toggle lever, and also formed in the lever lock insert, none of the lever lock structure extending laterally beyond the externally threaded, generally cylindrical housing.

4 Claims, 3 Drawing Figures

Fig. 1.
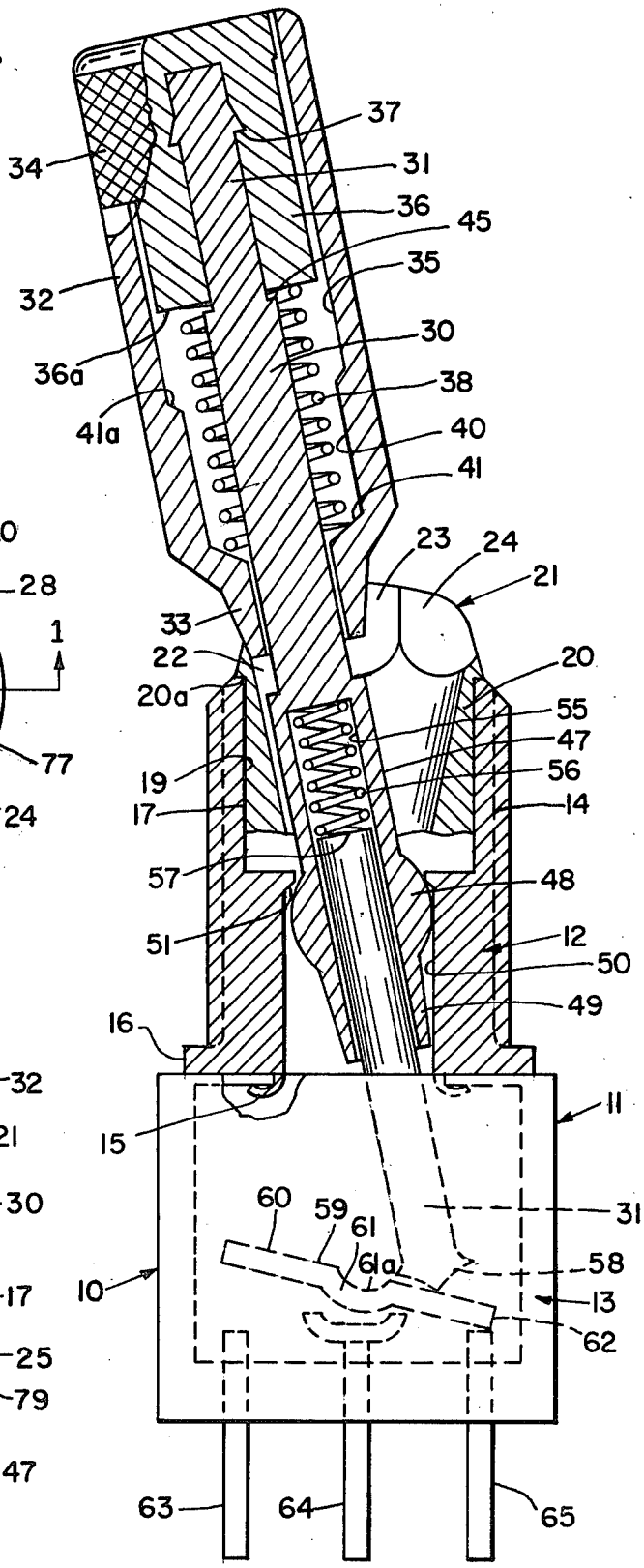
Fig. 2.
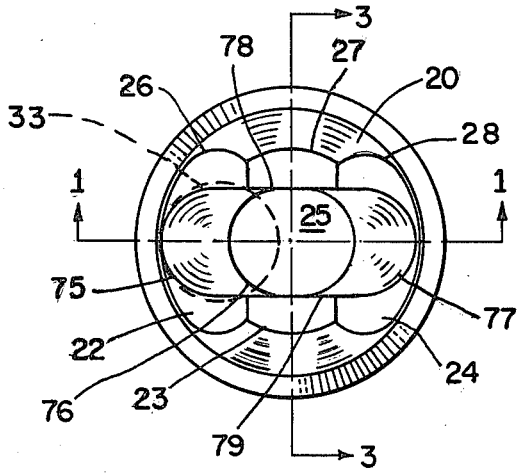
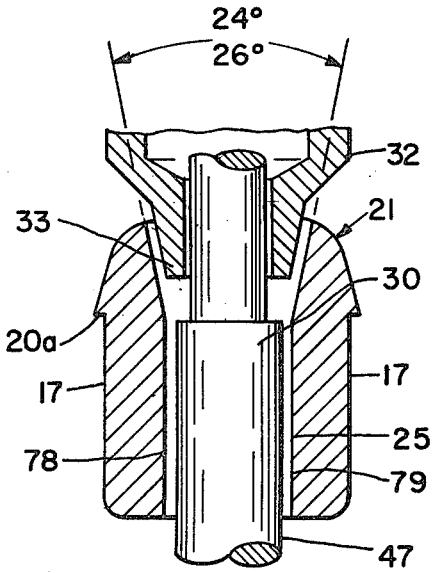
Fig. 3.

SUB-MINIATURE THREE POSITION SWITCH WITH BUILT-IN LEVER LOCK

RELATED APPLICATION

This application is a Continuation-In-Part of my application Ser. No. 337,594 filed Jan. 7, 1982, now abandoned.

BACKGROUND OF THE INVENTION

The present invention relates generally to toggle switches and particularly to toggle switches of the kind that require a particular manual action to reset the toggle switch from one state to another. Such switches avoid accidental setting, and require a deliberate action on the part of an operator to change state.

Such switches usually involve a stem or lever arm to be moved or rotated as a lever from one position to another to be set in another state. Before moving the stem or lever arm, however, a detent must be released to permit the movement, and when in the new position, a detent is again engaged to prevent accidental setting of the lever arm to an undesired state. Such a construction is particularly desirable where the switches are small and installed close together, so that a setting of one might lead to an undesired or unnoticed setting or resetting of another, adjacent switch.

In the construction of such switches, in sub-miniature size, the lever arm has been constructed and installed in such a way that it is restricted to swing in only one plane to operate the toggle switch reliably. To provide such a restriction different means have been employed. One is to drill a hole in the lever arm or stem through which is inserted a pin to serve as an axle about which the lever arm rotates. Thus, when the lever arm is rotated to one extreme position it sets the switch in one position, and when rotated to the other extreme position it sets the switch in the other position, and always acts in one plane.

A second manner of construction is to mill two flat portions opposite each other on the lever arm. These portions are guided by inner cooperating surfaces of the housing to restrict the motion of the lever arm substantially to a single plane.

In both instances, typically, a pin is inserted in a transversely drilled hole in the lever arm at its upper, or outer end. The pin is captured within an internally threaded cap which is screwed to a detent element. The detent element is slotted at its upper end to receive the pin in the slot, so that the detent element is always oriented at a fixed element with respect to the lever arm. The detent element carries at its lower end a pair of downward projections or tongues at each side of the lever arm axis. The spring under compression urges the detent element downward to engage the tongues in corresponding slots in the housing which define the toggle lever positions, and thus, a detent is formed keeping the lever arm in position unless the detent element is raised to release the detent for lever arm movement. The handle may be raised against the spring compression to disengage the detent element, and thus, to withdraw the tongues from the slots, and the lever arm may then be rotated in the restricted plane, either by virtue of the axle or of the flattened guide surfaces, to the new detent position, whereupon the handle is released, and the spring drives the detent projections into engagement with a different pair of slots in the housing to prevent inadvertent motion of the lever arm.

Such sub-miniature detent protected switches are exemplified, for example, by a toggle switch sold by Apr., Siege Social ET Usine 82270 Montpezat-De-Quercy, France as models 5636-2V or 5639-3V or by a toggle switch sold by Fujisoku Electric Company, Ltd. 1890 Kizuki Sumiyoshi-cho, Kawasaki-Shi Japan as models MTL-106D or MTL-106E.

It has also been proposed in U.S. Pat. No. 2,885,905 of May 12, 1959 to Larkin and U.S. Pat. No. 2,723,571 to Koenig of Nov. 15, 1955, to provide detachable lever locks on toggle switches of conventional dimensions, the lever locks being threaded on the cylindrical bushings and overhanging in the manner of a cap so as to be impractical if used in close packed, sub-miniature, circuitry.

SUMMARY OF THE INVENTION

According to this invention, the lever arm of such a subminiature switch is of circular symmetry with respect to its longitudinal axis, thus, providing for ease of manufacture and reduced expense compared to prior lever arms for such switches. The lever lock is a one piece insert having a generally cylindrical side face of substantial depth, and an outer, upper face of arcuate, or dome-like, configuration, the insert being press fitted into the cylindrical space within the externally threaded housing, or bushing, just above the spherical pivot seat for the bulbous portion of the toggle lever. The dome-like face of the insert includes a left recess, a central recess, and a right recess, all aligned in a straight line and each of generally truncated conical configuration with the large openings circular and adapted to receive the circular spring pressed detent on the toggle lever handle and the small openings at the bottom merging with the parallel, relatively deep side walls of a guide slot for the toggle lever.

BRIEF DESCRIPTION OF THE DRAWING

The various objects, advantages, and novel features of the invention will be more fully understood from the following detailed descriptions when read together with the drawing, in which like reference numerals refer to like parts, and in which:

FIG. 1 is a front elevational view in half section of one embodiment of the invention;

FIG. 2 is a top plan view of the dome of the embodiment of FIG. 1; and

FIG. 3 is a side elevation of a dome of the embodiment of FIG. 1, in section on line 3—3 of FIG. 2.

DESCRIPTION OF THE PREFERRED EMBODIMENTS

Referring now to FIG. 1, a lockable toggle switch 10 comprises a housing, or bushing, 11 having an upper portion 12 and a lower portion 13, as viewed in the drawing. It will be understood throughout, that upper and lower refer to this orientation of the switch as viewed in FIG. 1, and are not intended to be otherwise limited. The upper portion 12 is generally cylindrical and externally threaded as at 14 to permit attachment by internally threaded rings or bushings (not shown) to a circuit board or chassis or the like, in known manner, by engaging such a ring against the wall to grasp the wall between the ring and a flange 16 of the housing 11. The upper portion 12 has a pair or more of ears 15 at its lower end for crimping against, or under, an upper wall of the lower portion 13, to attach the two portions 12 and 13. The two portions may be attached in any other convenient fashion.

Within a comparatively large cylindrical internal diameter portion 19 of the upper housing portion 12, is press fitted an insert 20, having a cylindrical side wall 17 and having a shoulder 20*a* which rests against the upper rim of upper housing portion 12. The insert 20 carries an arcuate, upper, outer face or dome 21, and both dome and insert may be considered part of the housing though not necessarily integral therewith. The dome 21 (by which is not intended to restrict to any particular shape other than a cover) has a left recess 22, a central recess 23, and a right recess 24. A slot 25 centrally of the recesses defines the path of a stem or lever arm 30.

Each recess 22, 23, and 24 is of generally truncated conical configuration with its larger opening 26, 27, or 28 each of circular symmetry on the outer face, or dome 21, and its smaller opening 75, 76, or 77, at the bottom of its recess, merging with the straight parallel opposite walls 78 and 79, of the guide slot 25.

As shown in FIG. 3, the walls 78 and 79 of slot 25 are coextensive in depth with the side wall 17 of the insert, to provide an elongated area of slidable contact with the toggle lever for lateral support against sidewise tilting.

It is to be understood that upper portion 12, and domed insert 21, are preferably combined into one integral piece to suit manufacturing machinery available.

The lever arm 30 is circularly symmetrical about its longitudinal axis 31, thus affording a member simple and easy of manufacture and requiring no additional milling or drilling. A sleeve 32 encompasses the upper end of the lever arm 30 and has a lower, detent portion 33 and an upper, handle portion 34, which may be outwardly knurled for easy finger grasp, as shown. At its upper end, the sleeve 32 has an internal bore 35, of comparitively large internal diameter to receive an abutment or stop 36 for a spring 38. The stop, or abutment 36, is affixed to the upper end of the lever arm 30 by means of a sharp-edged extension 37 from the bottom of the stop or cap 36, until the shoulder 45 of the next larger diameter of the lever arm 30 is reached. The projection 37, thus will "stake" or engage in the softer material of the stop or cap 36 and hold it fast against the urging of the yieldable spring 38. The term "stake" seems apt, although the projection or lip 37 desirably extends uniformly around the axis 31, as shown, so that uniform circularity of the lever arm applies to the entire arm.

A reduced inner diameter 40 of the internal bore of sleeve 32 affords a shouler 41 against which the spring 38 bears at its other end, so that the sleeve 32 is yieldably urged by the spring 38 towards the dome 21.

Shoulder 41*a* afforded by the difference between internal bore 35 and reduced inner diameter 40, limits upward movement of sleeeve 32 by striking stop cap surface 36*a*.

A still larger outer diameter part 47 of lever arm 30 is lower and within the dome 21, and the upper cylindrical portion 12 of housing 11. At a still lower part the lever arm 30 is enlarged into a spherically bulbous portion 48 which, as will be more fully apparent hereinafter, serves as a bearing. Below the bulbous portion 48 of the lever 30 is an end portion 49, tapered to a reduced lower end. The diameter of the bulbous portion 48 is large enough to be comfortably held within the confines of a reduced internal diameter portion 50 of upper housing portion 12, and to be held captive therewithin by a circular ledge 51, which also acts as an internal bearing of the housing to be cooperative with the external bearing surface of the bulbous portion 48 of the lever arm 30.

At its lower end, the lever arm 30 has an internal bore 55 which extends upward beyond the bulbous portion 48 to receive a spring 56 and one end of a follower arm 57, which bears against the spring 56. At its lower end the follower arm has a follower, or head, 58 having a rather arrow-headed conformation, but any reasonable conformation, such as a plain, semi-spherical, or round end (not shown) may serve as well. The follower head 58, as used in electric switches, is usually an insulated follower head as shown in U.S. Pat. No. 4,117,284 of Kirchoff and Washburn granted Sept. 25, 1978. The head 58 bears against the upper surface of a rocker 59 which has a left arm 60, a center section 61 affording a hollow 61*a* to receive the rider head 58, and a right arm 62. In the position shown, the right arm 62 is held against a right contact 65 of three contacts 63, 64, and 65, respectively left, center and right. The head 58 and the follower arm 57 are yieldably urged against the arm 62 to hold it in contact with rocker 59. The lever arm bulbous portion 48 is thus reactively urged against the bearing edge 51.

In operation, if it is desired to move the lever arm to a different position, the detent portion 33 of the sleeve 32 is retracted by the handle 34 from the recess 22. The detent, thus, being released, the lever arm may now be moved clockwise, either to a position vertical as viewed in FIG. 1, or further clockwise to a position with the handle far to the right. The bearing surfaces of cooperating bulbous portion 48 and internal bearing portion 51, work together to permit such movement of the lever arm 30, and the lever arm is guided in a plane substantially parallel to that of the paper, as viewed in FIG. 1, by the parallel walls 78 and 79 of the slot 25, which do not permit the lever arm to vary much in its path. The slot being well remote from the bearing easily performs this guiding function in accordance with well known physics principles. When the handle is released, the spring 38 urges the handle of sleeve 32 downward to engage the detent portion 33 in truncated, conical recess 23, or 24, depending on whether the lever arm has been swung completely clockwise, or only to a vertical position. It should be noted that the detent portion 33 of sleeve 32 is also of circular symmetry, providing a further advantage in manufacture and cost saving, and a firm fit in the recess. No downwardly extending projections or ears need be provided, and no corresponding aligned slots, or the like, need be cut in the dome 21. At the same time, the follower, or head 58, urged by spring 56, rocks rocker 59 counter-clockwise from its position as shown to a position in which it is horizontal, and the head 58 lies in the hollow 61*a*, and then, if the lever arm motion is continued, to a position in which the rocker left arm 60 is down to make contact with the left contacts 63 and the center contact 64.

If the detent should be released when the lever arm 30 is vertical, and the hollow 61*a* receives the head 58, the two extreme arms 60 and 62 are both horizontal and make no contact with the contacts 63 and 65 respectively, and the lever arm makes contact only with center contact 64.

It is, therefore, apparent that the switch as shown in FIG. 1, may be a single pole double throw switch with an intermediate position. Thus, when the detent is engaged in the left detent recess 22, and the right arm 62 of the rocker 59 is depressed, an electrical circuit is completed between contacts 64 and 65. If the detent is engaged in recess 24, and the left rocker arm 60 is depressed, a circuit is completed between contacts 64 and 63. If the detent with the central recess 23 is engaged, then no circuit is completed, but the rocker arm contacts shown may be added to by installing a second contact respectively behind each of the three shown in the view of FIG. 1 to make a double throw switch as illustrated. Installing a third or fourth contact respectively in like manner would make a three pole or four pole switch.

In FIG. 2 the detent 33 is shown in dotted lines as it engages the truncated conical side wall of a recess such as 22, in dome 20. In FIG. 3, a clearance is shown between the detent 33 and the truncated side wall of the recess in dome 20 and a clearance is shown between the portion 47 of the toggle lever and the side walls 78 and 79 of guide slot 25 for clarity, but actually in a subminiature toggle switch it will be understood that the fit is close with the parts contacting each other.

I claim:

1. A sub-miniature lockable toggle switch of the type having a housing with a lower portion containing a rocker switch contact and switch terminals and an upper portion, an elongated toggle lever for actuating said rocker, including a handle and a bulbous spherical portion, said upper portion containing an internal bearing for said bulbous spherical portions and having a lever lock with a plurality of recesses for seating a spring pressed detent on the handle of the toggle lever and a slot for guiding the lever in a single plane of oscillation characterized by:

said upper portion of said housing being cylindrical, having a comparatively large, internal diameter portion, above said internal bearing, and having a one piece, lever lock insert sleeved therewithin;

said one piece, lever lock insert having an integral dome with a left recess, a central recess, a right recess, and a guide slot with parallel walls, central of said recesses, each recess having a generally circular, large outer opening for selectively receiving said detent and each having a smaller, inner opening jointly merging into said parallel walls of said guide slot, and of less length than the overall length of said recesses, for guiding said lever.

2. A sub-miniature lockable toggle switch as specified in claim 1 wherein:

said lever lock insert includes a generally cylindrical outer side wall of predetermined depth, and the parallel walls of said guide slot are also of said predetermined depth to offer a lateral support to said toggle lever against sidewise tilting.

3. A sub-miniature lockable toggle switch as specified in claim 1 wherein:

said dome includes opposite walls of said recesses, directly above the parallel walls of said slot, which define portions of truncated cones and said spring pressed detent on said handle is cylindrical to make a firm fit in any one of said recesses.

4. In a sub-miniature toggle switch of the type having an elongated toggle lever with a bulbous portion, a housing with a lower portion containing a see-saw rocker for contacting switch terminals, and an upper portion with an internal bearing for the bulbous portion of a toggle lever, for actuating said rocker, said toggle lever having a spring pressed handle and detent thereon, retractable from lock position to be moved to another lock position characterized by:

the upper portion of said housing being of cylindrical, configuration, with a large internal diameter portion therewithin, just above said internal bearing;

a one piece lever lock insert, having a generally cylindrical outer face of predetermined depth, press fitted in said comparatively large internal diameter portion, said insert having an arcuate upper, outer face with a left recess, a central recess and a right recess, each of generally truncated conical configuration and a guide slot with parallel walls central of said recesses, said recesses each having a large outer opening and a small inner opening, said large openings adapted to each selectively receive said detent and said small inner openings merging with said opposite parallel walls of said guide slot for slidably guiding said toggle lever, said guide slot walls being of predetermined depth co-extensive with the depth of the cylindrical outer face of said insert;

whereby said cylindrical housing is free of lateral projections and all of said lever lock insert is within the horizontal area occupied by said housing.

* * * * *